US005551403A

United States Patent [19]

Schmidt

[11] Patent Number: 5,551,403

[45] Date of Patent: Sep. 3, 1996

[54] FUEL SUPPLY QUANTITY LIMITING ARRANGEMENT

[75] Inventor: Guenther Schmidt, Meckenbeuren, Germany

[73] Assignee: MTU Motoren- Und Turbinen-Union Friedrichshafen GmbH, Germany

[21] Appl. No.: 511,232

[22] Filed: Aug. 4, 1995

[30] Foreign Application Priority Data

Aug. 4, 1994 [DE] Germany ..... 44 27 607.9

[51] Int. Cl.[6] ..... F02M 47/02

[52] U.S. Cl. ..... 123/510; 137/508

[58] Field of Search ..... 123/510, 511, 123/512, 198 D, 198 DB; 137/508

[56] References Cited

U.S. PATENT DOCUMENTS

| | | | |
|---|---|---|---|
| 3,093,155 | 6/1963 | Dawes | 137/508 |
| 3,138,040 | 5/1965 | Gold | 137/508 |
| 3,387,597 | 6/1968 | Wirsching | 123/511 |
| 3,780,716 | 12/1973 | Fenne . | |
| 4,222,358 | 9/1980 | Hofbauer | 123/511 |
| 4,925,196 | 5/1990 | Green et al. | 123/198 DB |
| 5,339,785 | 8/1994 | Wilksch | 123/467 |
| 5,365,906 | 11/1994 | Deweerdt | 123/510 |
| 5,390,692 | 2/1995 | Jones et al. | 123/467 |

FOREIGN PATENT DOCUMENTS

| | | |
|---|---|---|
| 0150138A2 | 7/1985 | European Pat. Off. . |
| 2334834 | 7/1977 | France . |
| 2207643 | 8/1994 | Germany . |
| 447714 | 3/1968 | Switzerland . |
| 2043777 | 10/1980 | United Kingdom . |

*Primary Examiner*—Thomas N. Moulis
*Attorney, Agent, or Firm*—Evenson, McKeown, Edwards & Lenahan, P.L.L.

[57] ABSTRACT

An arrangement limits a fuel supply from a fuel pressure reservoir by way of a controllable injection valve into the combustion space of an internal-combustion engine. The fuel flow is interrupted as a function of the forces applied to a spring-prestressed valve separating piston in the event of an outlet-side pressure drop. A reliable limiting of the maximal injected fuel quantity is achieved by providing a flow-through opening penetrating the separating piston with a closing device. This flow-through opening can be closed as a function of the displacing direction of the separating piston. If the displacing device closes the flow-through opening in the starting position, during the injection phase and in the piston end position, the limiting valve will continuously interrupt the fuel flow in the case of an outlet-side pressure drop. Alternatively, the flow-through opening is such that a fuel filter cartridge can be inserted into the separating piston, through which fuel, which was apportioned between two respective injection phases, flows during the restoring stroke.

20 Claims, 2 Drawing Sheets

FUEL SUPPLY QUANTITY LIMITING ARRANGEMENT

BACKGROUND AND SUMMARY OF THE INVENTION

The present invention relates to an arrangement for limiting the supply of fuel from a fuel pressure reservoir by way of a controllable injection valve into the combustion space of an internal-combustion engine. More particularly, the present invention relates to a controllable injection valve for injection into a combustion space of an internal-combustion engine, comprising a housing, an interior space formed in the housing having an inlet and an outlet, and a separating piston inserted in the interior space to divide the interior space into an inlet-side chamber and an outlet-side chamber in a liquid-tight manner. The separating piston is prestressed by a first spring against a fuel flow direction, and which, under the effect of forces applied thereto, is displacably arranged in a displacing direction between a starting position and an end position. A flow-through opening is formed in the separating piston to selectively connect the chambers with one another. The separating piston, at least in the end position, interrupts fuel flow-through. A displacement device is operatively arranged in the housing for closing the flow-through opening as a function of an axial displacing direction of the separating piston.

Known quantity limiting arrangements have different designs and methods of operation. Despite their constructionally different designs, however, these known arrangements all operate according to the same operating principles, specifically as a safety element during the occurrence of a disturbance in the fuel injection system and as a metering device in order to limit the quantity of injected fuel to a defined extent. If, for example, because of flow conditions, the injection valve does not close as intended, these quantity limiting arrangements separate the high pressure portion of the injection system from the injection valve and, therefore, prevent a continuous injection which may damage or even destroy the internal-combustion engine.

DE-OS 22 07 643 describes a valve in which the separating piston is displaced during the injection phase by a path corresponding to the injected amount of fuel against the force of the restoring spring. When the injection valve closes, the separating piston is moved back into its starting position under the effect of the restoring spring, while the fuel displaced in the process passes the piston through a piston duct.

When the injection valve does not close any further, in the known systems, a continuous injection of fuel is prevented by the piston while utilizing the pressure difference existing at the piston. Because, when then injection valve is closed, the fuel pressure existing on the output side at the piston is comparatively low, and, on the input side, the constantly high injection reservoir pressure acts upon the separating piston, the piston is pressed in the direction of and against the piston stop. In this position, the separating piston seals off the outlet of the quantity limiting arrangement and thus prevents a fuel injection.

Although the known quantity limiting arrangement prevents a continuous injection in the case of high system pressures, it does not offer sufficient protection against a continuous injection in operating ranges with a reduced system pressure of 100–300 bar, as occur, for example, during the starting operation and during the starting phase of the internal-combustion engine. Then, this known arrangement is particularly disadvantageous because, for example, by a corresponding dimensioning of the piston restoring spring, it is adapted to high system pressures and, when the system pressure is reduced, because of the small pressure difference occurring at the separating piston, the piston is not activated or is not activated sufficiently. For this reason, fuel will flow through the piston duct into the combustion space in an unhindered manner.

Injection quantity limiting arrangements are required particularly in fuel injection systems in which the fuel is continuously acted upon by a high pressure in a pressure reservoir and is injected into the combustion space from this pressure reservoir by a correspondingly controlled opening of injection valves constructed especially for such an accumulator charging. DE 31 19 050 A1 describes such a quantity limiting arrangement which is arranged as a safety valve in the housing of an injection valve between the accumulator space and the seat surface for the nozzle needle. A movable part of this arrangement, which is normally held in the open position by a spring, can be loaded by way of a piston with the fuel pressure in the accumulator space so that the movable part arrives in the closed position. This safety valve is also adapted to high system pressures so that, when system pressures are reduced, the pressure energy will not be sufficient for overcoming the restoring force of the spring. An interruption of the fuel flow is therefore not ensured in the case of such a system operation. In addition, a separate change-over valve is required for the described safety valve in order to control the pressure admission to the piston. As a result, this quantity limiting arrangement, which consists of the change-over valve and the safety valve, requires high expenditures and costs.

Furthermore, the above-described known injection valve and other injection valves suitable for accumulator charging have a number of throttling points and control ducts which is higher than in the case of conventional injection valves, which renders these valves more susceptible to disturbances with respect to dirt particles or chips carried along in the fuel flow. Because even small suspended particles may prevent a clean valve closure, the connected risk is relatively high of a continuous fuel injection into the combustion space and finally of damage to the internal-combustion engine.

An additional disadvantage of the known valve is that no control or indicating possibilities are provided by way of which the actual operating condition of the quantity limiting arrangement and/or the failure or an occurring disturbance of an injection valve can be indicated or determined.

It is, therefore, an object of the present invention to provide an arrangement for limiting the maximally possible quantity of fuel injected into the combustion space which, independently of the operating condition, permits a reliable limiting of the maximal quantity of injected fuel and which, as a safety element, protects the engine from possible damage.

This object has been achieved in accordance with the present invention by providing a displacement device such that the flow-through opening is closeable as a function of the displacing direction of the separating piston.

One essential advantage of the arrangement according to the present invention comprising a separating piston and a closing device is the resulting liquid-tight separation of the high-pressure portion of the injection system with respect to the injection valve in the starting condition, during the injection phase and possibly beyond that during the whole period in which the injection valve is switched into its open position. This separation of the fuel supply to the injection valve which is created as a function of the displacing direction of the separating piston has the effect that, even in the case of the smallest pressure differences applied to the separating piston, no fuel can flow past the separating piston. As a result, even in the case of a malfunctioning of the injection valve in low-pressure ranges during the starting phase of the internal-combustion engine, the separating piston is displaced to the right stop and therefore reliably prevents continuous injections.

With the arrangement of the present invention, the fuel supply and the fuel metering are uncoupled. During the restoring stroke, while the closing device is open, the fuel quantity corresponding to the respective separating piston stroke is displaced through the flow-through opening into the outlet-side chamber. This arrangement ensures that, independently of the fuel quantity injected during the preceding injection phase, at the beginning of each injection, the constructively determined maximal fuel supply quantity is available in the outlet-side chamber. The fuel injection and the fuel metering therefore take place in successive time periods and each of the functions can be optimally adapted to the different variables which determine those functions.

When the injection valve is open, while utilizing the high fuel pressure existing on the high pressure side on the separating piston, a supply of fuel to the injection valve takes place which is as unhindered as possible. Irrespective of the duration of the injection phase, the fuel quantity is maximally injected which was constructively provided by the volume of the outlet-side chamber (i.e. with the piston in the starting position).

The fuel afterflow into the outlet-side chamber is advantageously provided in the longer time period of the restoring stroke of the separating piston. Because the injection valve is closed during the restoring stroke, the previously injected fuel quantity can be redelivered without having to consider the desired injection course inasmuch as the injection course is determined by the working stroke of the separating piston.

Special advantages are achieved if the closing device is constructed in the housing interior in a self-regulating manner without any external control because this provides an operation of the device which is independent of disturbing outside influences and results in particularly low component expenditures and, therefore, in a particularly low susceptibility to disturbances.

Up to now, an additional fuel filter was connected, as a measure against the dirt-caused susceptibility to disturbances of used injection valves, directly in front of the injection valve into the fuel pipe and keeps back the suspended substances. Because during the injection, large fuel mass flows flow through the filter, as a result of the system, conventional filters had to have very large dimensions so that the filter will cause no additional throttling point in the inflow system which may impair the course of the injection. In one currently preferred further embodiment of the quantity limiting arrangement according to the invention, the fuel filter is combined with the separating piston. This filter is inserted into a correspondingly constructed receiving space in the separating piston. As a result, the filter cross-section may be sized much smaller than fixedly installed conventional filters because, during the piston restoring stroke, thus in the phase which is between two injections, fuel will flow through the filter. In this phase, the filter-caused throttling effect plays a subordinate role. Furthermore, occurring throttling losses may simply be compensated by a correspondingly strong dimensioning of the piston restoring spring.

If the fuel filter is gradually closed by dirt particles, when conventional filters are used, the corresponding filter was not supplied with the fuel quantity corresponding to the operating requirements of the engine, but, with a considerably impaired efficiency, was operated until either the filter was completely clogged or the engine was switched off because of a noticeable operating behavior. In contrast, the filter according to the present invention which is inserted into the separating piston advantageously indicates its own maintenance intervals. When this filter reaches a degree of contamination which impairs the flow-through of fuel, a fuel back pressure is generated in front of the filter which equals an inflow-side pressure increase. Because of the resulting pressure compensation weight on the separating piston, this separating piston is displaced correspondingly more and farther toward its closed position. In such a system compensation, the quantity limiting arrangement will close before the cylinder is insufficiently supplied with fuel. This means therefore that, starting from a certain contamination of the filter, the cylinder arranged behind it is switched off before it is supplied in an uneconomical manner. A delaying or exceeding of the filter servicing intervals is therefore impossible. After the cleaning of the filter, the engine can continue to be operated normally.

A further currently preferred embodiment of the present invention provides a device for determining the separating piston position. The desired optimized injection course is not disadvantageously influenced by the device according to the invention, although, by way of an additional monitoring and control device, the protection against continuous injections and connected engine damage can be increased significantly.

The above considerations were carried out in the manner of an example by reference to a one-cylinder engine. In practice, in the case of an internal-combustion engine, the complicated interplay of several cylinders must be mutually coordinated. When considering the entire internal-combustion engine, control-caused, as well as construction-caused, differences occur from one cylinder to the next. For optimization of this interplay of all cylinders of an internal-combustion engine, it is therefore of principal significance to detect the fuel supply as comprehensively and precisely as possible. Based on these monitored operating data, possibly occurring deviations and disturbing influences can be correspondingly controlled by the engine electronic system.

A main advantage of the device for determining the piston position according to the present invention is that the respective momentarily injected fuel quantity can be determined by a path signal which can be measured relatively easily with the constructively determined, known geometrical dimensions. In addition, information is obtained directly from the path measurement concerning the start and the end of the injection. Furthermore, the breakdown of an injection valve dan be determined without any time delay which had been impossible up to now.

A further embodiment of the piston path measuring device according to the present invention as a no-contact position measuring device has the advantages of no-wear measuring devices and resulting low susceptibilities to disturbances which lead to a correspondingly long service life. In yet another currently preferred embodiment of the invention, an inductive path measuring device is used for this purpose whose components are available as standardized parts.

For a simple, low-cost construction of a measuring device, it is suggested to mount a signal generator, for example, a conductor coil, on the outer circumference of the housing, for the purpose of which the housing is constructed of non-magnetic materials, but the separating piston is constructed of magnetic materials.

BRIEF DESCRIPTION OF THE DRAWINGS

These and other objects, features and advantages of the present invention will become more readily apparent from the following detailed description thereof when taken in conjunction with the accompanying drawings wherein.

DETAILED DESCRIPTION OF THE DRAWINGS

Figure 1:
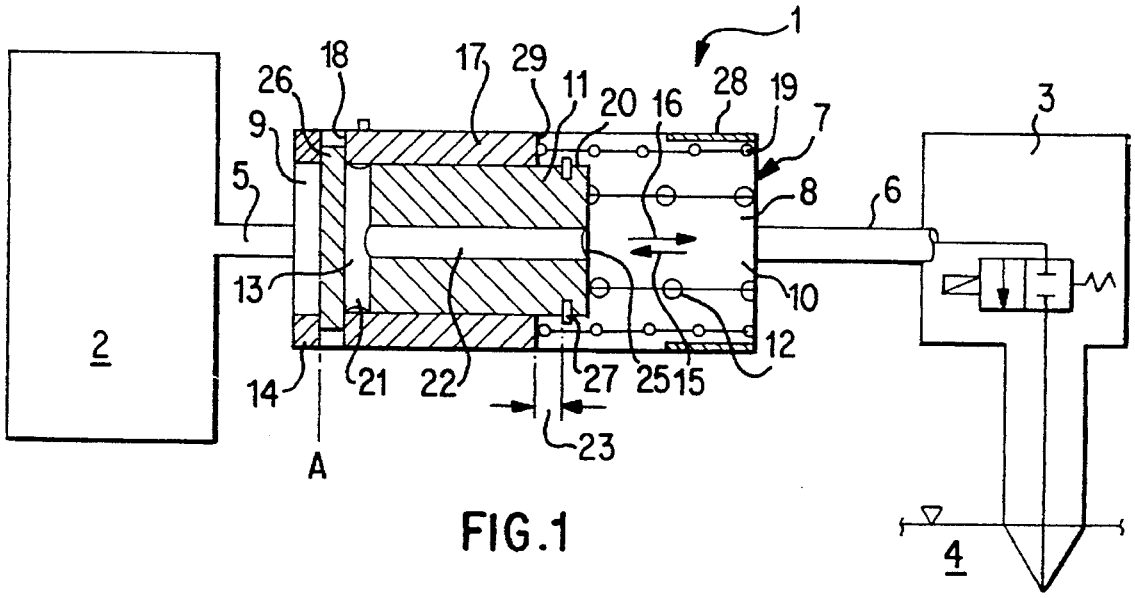
FIG. 1 is a schematic elevational view of a first embodiment of a pressure reservoir fuel injection system according to the present invention in the starting position.
Figure 2:
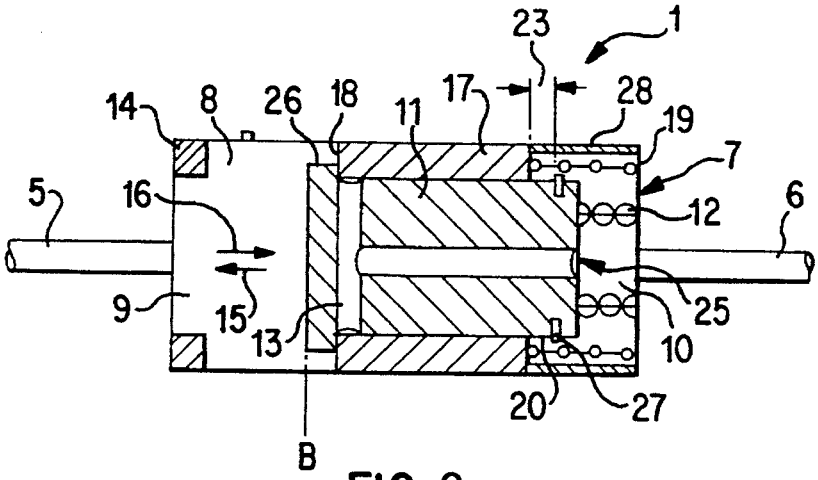
FIG. 2 is a view of the arrangement of FIG. 1 in which the separating piston is situated in the end position.
Figure 3:
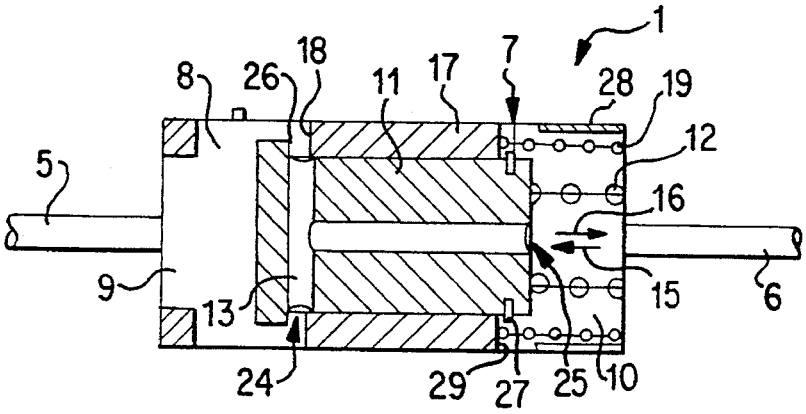
FIG. 3 is a view of the arrangement of FIG. 1 in a piston position during the restoring stroke.

FIGS. 1, 2 and 3 are sectional views of the injection quantity limiting arrangement according to the invention for three different positions, in which case the fuel injection system illustrated in FIG. 1 comprises a fuel pressure reservoir 2, an electromagnetically switchable injection valve 3, and a quantity limiting arrangement designated generally by numeral 1 and connected in between the reservoir 2 and the valve 3, by way of a respective inlet 5 and an outlet 6, in a manner which is basically known. In all three embodiments described below, the quantity limiting arrangement 1 according to the present invention has the same basic construction so that, for describing these three embodiments, identical parts use the same respective reference numerals.

Basically, the quantity limiting arrangement 1 according to the invention may be constructed in the form of a physically separately constructed assembly within the fuel injection system, however, this arrangement can also be physically connected with the injection valve 3.

Independently of the assignment of the arrangement 1 within the fuel injection system carried out on the housing side, the arrangement 1 consists of a housing 7, 7' which forms an cylindrical interior 8. This interior 8 is conductively connected by way of the inlet 5 with the fuel pressure reservoir 2 and by way of the outlet 6 with the injection valve 3 as noted above. In the flow path between the inlet 5 and the outlet 6 in the interior 8, a separating piston 11, 11' is inserted which can be displaced coaxially with respect to the center axis of the cylinder and which is prestressed against the fuel flow direction 16 by a spring 12 which is supported on the outlet-side interior wall.

In a starting position (A), the spring 12 presses the piston 11, 11' against an axial stop 14 constructed on the inlet-side interior wall of the housing 7, 7'. The separating piston 11, 11' also has a cylindrical shape and is constructed with a flow-through opening 13. The flow-through opening 13 is a transverse bore 13 which penetrates the separating piston 11, 11' in a radial manner and which is conductively connected with a coaxial longitudinal bore 22 which is open on one side in the direction of the outlet side.

Coaxially with the separating piston 11, 11', a sleeve 18 is provided on the outer circumference of the separating piston 11, 11' which can be displaced in the axial direction on the lateral surface area of the separating piston 11, 11'. This sleeve 18, which surrounds the separating piston 11, 11' along the circumference slides by way of its radially exterior lateral surface area along the interior wall of the housing and, together with the separating piston, therefore forms a liquid-tight separation of the interior 8 into an inlet-side chamber 9 and an outlet-side chamber 10. The only conductive connection between the inlet-side chamber 9 and the outlet-side chamber 10 is formed by the flow-through opening 13 constructed as a combined transverse bore 21 and longitudinal bore 22.

The axial length of the sleeve 18 is smaller than the axial length of the separating piston 11, 11', and is selected such that the sleeve 18 can be moved relative to the piston 11, 11' along a displacing path 23 determined by two stops 26, 27 on the piston 11, 11'. The stop 26 is constructed as a one-piece stop shoulder extending along the entire piston circumference, whereas, for mounting reasons, the stop 27 may be provided, for example, as a saw ring. Like the separating piston 11, 11', the sleeve 18 is prestressed by a spring 19 against the fuel flow direction 16. In the starting condition, the inlet-side frontal end of the sleeve 18 rests against the stop 26.

An essential aspect of the present invention is that the outside diameter of the sleeve 18 is larger than the outside diameter of the inlet-side faces of the separating piston 11, 11'. In the corresponding selection of these diameters, the inlet-side pressure application surfaces of the separating piston 11, 11' and of the sleeve 18 can thus be coordinated with one another. The outlet-side pressure application surfaces (and therefore also the applied pressure forces) are determined largely by the construction. Likewise, by way of the spring 12 and the spring 19, a defined restoring force may be constructionally determined. In this type of dimensioning, it is important that the restoring force of the spring 12 is larger than the restoring force of the spring 19, but both forces together are smaller than the pressure forces which, in the case of correspondingly selected inlet-side flow cross-sections of the separating piston 11, 11' and of the sleeve 18 are applied thereto.

On the outlet side, the displacing path of the separating piston 11, 11' is bounded by an axial stop 28 which is constructed at a distance from the interior wall of the housing 7, 7' and determines the end position of the separating piston 11, 11'. The axial lengths of the sleeve 18 and of the separating piston 11, 11' or the distance of the axial stop 28 from the outlet-side housing wall are selected such that the outlet-side frontal end 29 of the sleeve 18 moves against this axial stop 28 and the separating piston 11, 11' is supported by way of the sleeve 18 in its end position B.

The displacing path 23 of the sleeve 18 is determined by the axial distance of the stops 26, 27, on one hand, and by the axial length of the sleeve 18. The length of this displacing path 23 is dimensioned at least such that it is identical to or larger than the diameter of the radial inlet opening 24 of the transverse bore 13. As illustrated in FIGS. 1 to 5, the axial distance of the transverse bore 13 from the inlet-side face of the separating piston 11, 11' is selected such that the radial inlet openings 24 of the transverse bore 13 in the area of the displacing path 23 travelled by the sleeve 18 are situated directly adjacent to the stop 26. According to the position of the sleeve 18 relative to the separating piston 11, 11', the radial inlet openings 24 according to the present invention are covered or exposed by the sleeve 18 which, as a result, functions as a closing element.

The method of operation for limiting the fuel flow according to FIGS. 1 to 3 is now described. In the initial position A, thus when the injection valve 3 is closed, the separating piston 11, 11' is in its starting position A. In this position, a pressure equilibrium is applied to the separating piston 11, 11' on the inlet side and the outlet side. The separating piston 11, 11' is prestressed by the restoring spring 12, and the sleeve 18 is prestressed by the restoring spring 19 into the illustrating starting position A. In its starting position, the sleeve 18 is prestressed against the frontal stop 26 so that the radial inlet openings 24 of the transverse bore 13 are covered by the sleeve 18, and there is no conductive connection between the inlet 5 and the outlet 6.

In its starting position A, the separating piston 11, 11' is pressed against the axial stop 14. Consequently, a pressure buildup volume is provided between the inlet-side interior housing wall and the inlet-side frontal end of the separating piston 11, 11'. By way of this pressure buildup volume, it is ensured that the in-flowing fuel can act also in the starting condition upon an application surface required for the excursion of the piston.

If, during the injection phase, the injection valve 3 is supplied with current, so as to be opened up, fuel flows from the outlet-side chamber 10 through the injection valve 3 into the combustion space 4 of the internal-combustion engine. At the same time, the pressure drops in the outlet-side chamber 10, while a constant high pressure exists in the inlet-side chamber 9. Because of this pressure difference which therefore occurs at the separating piston, the piston is displaced against the prestressing force of the springs 12 and 19 together with the sleeve 18 in the direction of the arrow 16. The injected fuel quantity is proportional to the displacement path of the separating piston 11, 11'. During this stroke movement of the piston in the direction of the arrow 16, the inlet openings 24 of the transverse bore 13 are tightly closed by the sleeve 18. The inlet-side chamber 9 is sealed off in a liquid-tight manner with respect to the outlet-side chamber 10.

The end of the injection phase is initiated by the interruption of the current supply, whereupon the injection valve 3 closes and no more fuel will be injected. Simultaneously with the interruption of the fuel flow through the injection valve 3, a pressure equilibrium occurs again between the inlet-side chamber 9 and the outlet-side chamber 10 and therefore on the separating piston 11, 11'. Since, in this condition, shortly after the closing of the injection valve 3, the pressure forces acting on both sides on the separating piston 11, 11' mutually cancel one another, while neglecting possible frictional forces, the restoring force of the spring 12 acts on the separating piston 11, 11' and the restoring force of the spring 19 acts on the sleeve 18.

Figure 4:
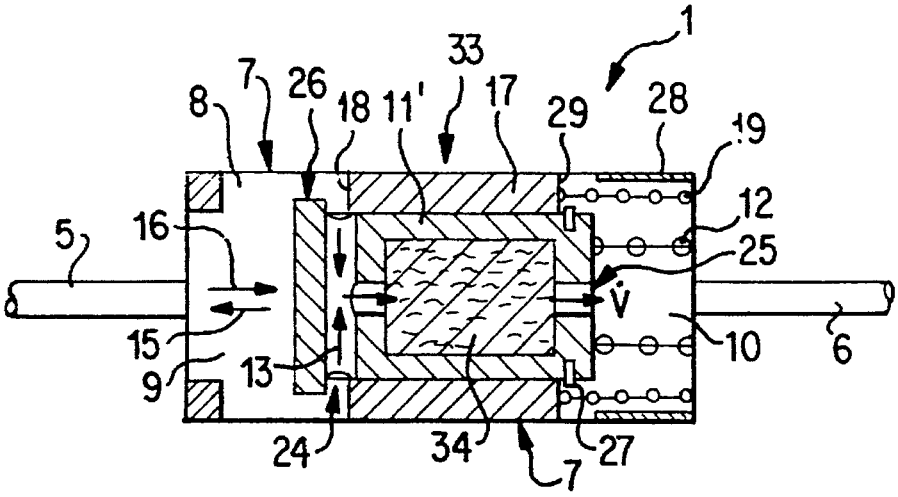
FIG. 4 is a view of a second embodiment of the arrangement according to the present invention with a combined fuel filter.

Because the spring 12 is clearly dimensioned to be stronger than the spring 19, however, the separating piston 11, 11' experiences a clearly higher restoring effect than the sleeve 18. These restoring forces of different strengths exercised on the separating piston 11, 11' and on the sleeve 18 also cause a displacement of the separating piston 11, 11' and the sleeve 18 in the direction of the arrow 15 which differs in speed. This corresponds to a displacement of the piston 11, 11' relative to the sleeve 18, whereby the sleeve 18 exposes the transverse bore 13 or its radial inlet openings 24 as illustrated in FIGS. 3 and 4. Through the exposed flow-through opening 13 of the piston 11, 11', the fuel volume flow displaced on the inlet side during the restoring displacement 15 of the piston 11, 11' can now flow off continuously from the inlet-side chamber 9 through the transverse and longitudinal bore 21, 22 into the outlet-side chamber 10. During the restoring movement in the direction of the arrow 15, the separating piston 11, 11' takes along the sleeve 18 by way of the stop 27 until the piston 11, 11' has reached its starting position A. With a corresponding delay, the sleeve 18 is from then on set back by its weaker spring 19 into its starting position against the stop 26, whereby it again covers and closes the transverse bore 21, and a working cycle is concluded.

The flow-through conditions and the extent of the applied forces of the quantity limiting valve are coordinated with one another such that the entire restoring time of the separating piston 11, 11' and of the sleeve 18 is always shorter than the time interval between two successive injection phases in the full load operation of the internal-combustion engine.

If an interference occurs with the injection valve 3 so that this valve will no longer close, in contrast to the above-described normal injection course, the situation illustrated in FIG. 2 occurs. The reason that, if the injection valve 3 remains in the open condition because of an interference, the separating piston 11, 11' and the sleeve 18 are displaced with respect to the above-described normal operation in the direction 16 until the outlet-side frontal end 29 of the sleeve 18 moves against the axial stop 28. In this position, while the injection valve 3 is open, tile high fuel reservoir pressure acts on the inlet side on one side onto the separating piston 11, 11' and the sleeve 18, whereby these are pressed continuously into the separating piston end position B.

The separating piston 11, 11' and sleeve 18 together as a system, in the starting position A of the separating piston 11, 11', during the displacing movement in the direction 16 and in the end position B, are constructed to be absolutely liquid-tight, even during operating conditions, such as the starting operation during which a reduced system pressure exists on the inlet side on the arrangement according to the invention. Consequently, no fuel can flow past the separating piston 11, 11' but, in the case of an increasing inlet-side pressure buildup, as in the normal operation during normal system pressure, the piston is displaced in the direction 16 against the stop 28 and, as a result, the fuel supply to the injection valve 3 is continuously interrupted.

FIG. 4 illustrates a second embodiment of the quantity limiting arrangement according to the invention which, in contrast to the embodiment illustrated in FIGS. 1 to 3, is equipped with an additional fuel filter 34. A hollow space is formed in the separating piston 11', which hollow space is connected by way of the inlet openings 24 with the inlet-side chamber 9 and is connected by way of the outlet opening 25 with the outlet-side chamber 10. The filter 34, which is, for example, constructed as a filter cartridge, is inserted in this hollow space and is displaced in the arrangement 1 together with the separating piston 11'.

During the injection phase, thus during the displacing movement in the direction 16, the filter 34 is also displaced as a part of the combined separating piston 11, 11' / sleeve 18 system, as described above, corresponding to the injection fuel quantity. Because of the flow-through opening 13, which is covered during this piston stroke movement, no fuel flows through the filter 34. After the conclusion of the injection, when the piston 11' is restored in its starting position and the sleeve 18 exposes the inlet openings 24, the volume flow displaced from the inlet-side chamber 9 during the restoring movement will flow through the piston passage opening 13 and therefore through the fuel filter 34 into the outlet-side chamber 10.

Because this filtering operation takes place during the restoring stroke (arrow 15) and the restoring periods required for this purpose may be compensated or set by the corresponding dimensioning of the restoring spring 12, the course of the injection is completely unaffected by the insertion of the fuel filter 34. Particles carried along in the fuel flow are also filtered out immediately before entering the injection valve 3 and the risk of a disturbance is therefore reduced.

Figure 5:
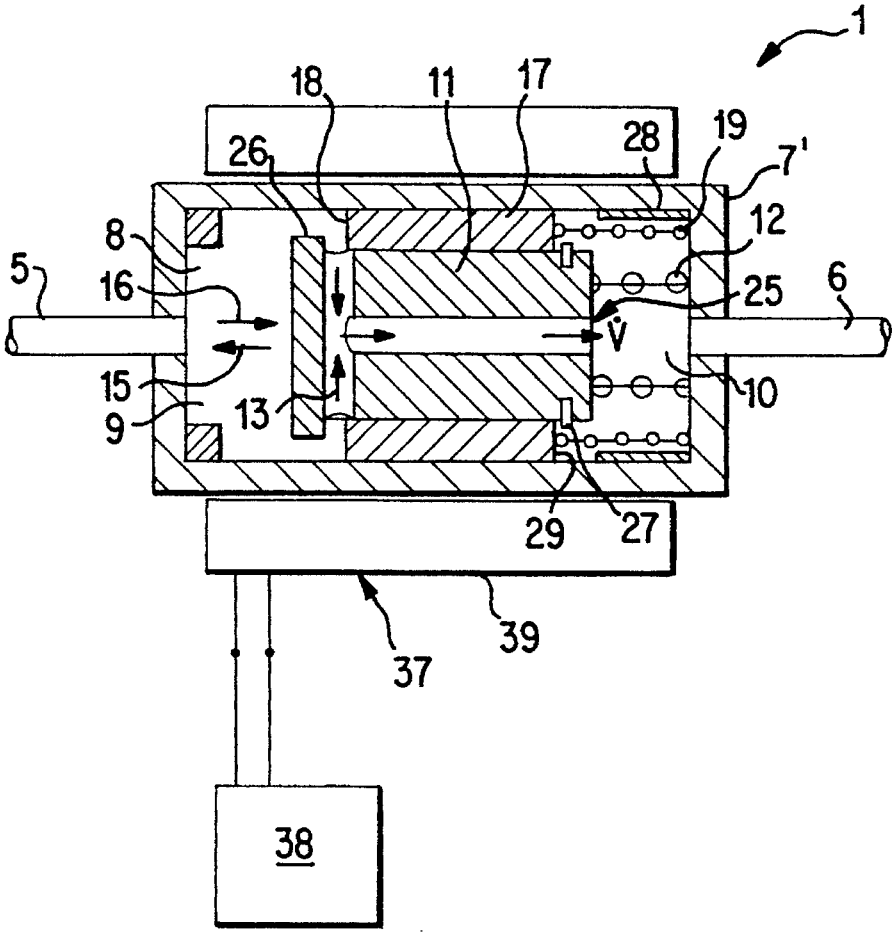
FIG. 5 is a view of a third embodiment of the arrangement according to the present invention with a device for determining the separating piston position.

FIG. 5 illustrates a third embodiment of the quantity limiting arrangement according to the present invention which is constructed with a device for determining the separating piston position. The basic construction and method of operation of the quantity limiting arrangement illustrated here correspond essentially to the embodiment illustrated in FIGS. 1 to 3. This arrangement is equipped with an induction measuring device, in which, in a no-contact measuring process, the momentary position of the separating piston 11 in the interior 8 is determined. In order to permit the desired induction measurement, the housing 7' is made of a non-magnetic material, whereas the separating piston 11 and the sleeve 18 are magnetic materials. On the circumference, the housing 7' is surrounded by a conductor coil 39 in which, because of the displacing movement of the piston, a current is induced in the conductor coil 39. An analyzing unit 38 connected with the coil 39 determines the momentary position of the separating piston 11 from this induced current.

Corresponding to the momentary piston position determined in the analyzing unit 38, either the injection periods are adjusted in a compensating manner or a control display is initiated. If the piston 11' remains in the position illustrated in FIG. 3 over an extended time period, the analyzing unit 38 determines a "continuous injection", whereupon, in addition to a warning display, optionally, a corresponding emergency procedure may be started simultaneously. In a corresponding analysis over one or several working cycles, it is therefore possible to determine with this measuring device the start of the injection, the end of the injection and possibly the existence of a disturbance. Furthermore, by way of the known geometrical dimensions of the quantity limiting arrangement, the injected fuel quantity can be determined as a function of the determined displacing path.

Although the invention has been described and illustrated in detail, it is to be clearly understood that the same is by way of illustration and example, and is not to be taken by way of limitation. The spirit and scope of the present invention are to be limited only by the terms of the appended claims.

What is claimed is:

1. An arrangement for limiting supply of fuel from a fuel pressure reservoir to a controllable injection valve for injection into a combustion space of an internal-combustion engine, comprising a housing, an interior space being formed in the housing having an inlet and an outlet, a separating piston inserted in the interior space to divide the interior space into an inlet-side chamber and an outlet-side chamber in a liquid-tight manner, the separating piston being prestressed by a first spring against a fuel flow direction, and which, under the effect of forces applied thereto, is displacably arranged in a displacing direction between a starting position and an end position, a flow-through opening being formed in the separating piston to selectively connect the chambers with one another, and the separating piston, at least in the end position, interrupting fuel flow-through, wherein a closing device is operatively arranged in the housing for closing the flow-through opening as a function of an axial displacing direction of the separating piston.

2. The arrangement according to claim 1, wherein, in the starting position of the separating piston, during an axial displacement movement of the separating piston from its starting position against spring prestressing and in its end position, the flow-through opening is closable via the closing device.

3. The arrangement according to claim 1, wherein the closing device is arranged in a self-regulating manner in the interior.

4. The arrangement according to claim 3, wherein the closing device is configured to be operable in response to inlet-side and outlet-side forces.

5. The arrangement according to claims 1, wherein the closing device is operatively connected with the separating piston to be movable relative to the separating piston.

6. The arrangement according to claim 5, wherein the closing device is a sleeve prestressed by a spring against a fuel flow direction and provided in a liquid-tight manner between the separating piston and an interior wall of the housing on a lateral surface area of the separating piston so as to be coaxially displaceable in the axial displacing direction along a defined axial displacing path.

7. The arrangement according to claim 1, wherein the flow-through opening is a bore with at least one inlet opening leading out radially in an area of the displacing path selectively covered by the sleeve and with an outlet opening leading out into the outlet-side chamber.

8. The arrangement according to claim 7, wherein the displacing path and a length of the sleeve are sized relative to one another such that, depending on the position of the sleeve relative to the separating piston, the inlet opening is one of open, partially covered and completely covered and closed by the sleeve.

9. The arrangement according to claim 5, wherein a restoring effect of the separating piston by the spring is larger than a restoring effect of the sleeve by the spring.

10. The arrangement according to claim 6, wherein the first spring is supported on the housing.

11. The arrangement according to claim 6, wherein the first spring is supported on the separating piston.

12. The arrangement according to claim 6, wherein the axial displacing path of the sleeve relative to the separating piston is bounded by two stops protruding radially beyond the lateral surface area of the separating piston.

13. The arrangement according to claim 6, wherein the end position of the separating piston is determined by an axial stop in the outlet-side chamber, the outlet-side frontal end of the sleeve being arranged to move against the axial stop, and respective lengths of the sleeve and of the separating piston being sized such that, in the end position, the sleeve is on one of the two stops in its starting position relative to the separating piston, in which the inlet opening is covered by the sleeve.

14. The arrangement according to claim 1, wherein a hollow space is formed in the separating piston and is connected by an inlet opening with the inlet-side chamber and an outlet opening with the outlet-side chamber.

15. The arrangement according to claim 14, wherein a fuel filter is arranged in the hollow space.

16. The arrangement according to claim 1, wherein a device is operatively associated with the housing for determining a position of the separating piston.

17. The arrangement according to claim 16, wherein the device comprises a measuring device and an analyzing unit operatively associated with the measuring device to measure the position in a no-contact manner.

18. The arrangement according to claim 17, wherein the housing consists of a non-magnetic material, and the separating piston and the sleeve consist of magnetic materials, and the measuring device comprises a generator external to the housing is provided to emit signals to the analyzing unit which provides information on an instantaneous separating piston position.

19. The arrangement according to claim 17, wherein the measuring device is a capacitive-type device.

20. The arrangement according to claim 16, wherein the device is configured to determine a start of injection stage, an injected quantity, an end of the injection stage and a breakdown of the injection stage.

* * * * *